US008607721B2

(12) United States Patent
Koga et al.

(10) Patent No.: US 8,607,721 B2
(45) Date of Patent: Dec. 17, 2013

(54) SEWING MACHINE AND COMPUTER READABLE MEDIUM

(75) Inventors: Chiyo Koga, Nagoya (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/372,046

(22) Filed: Feb. 13, 2012

(65) Prior Publication Data

US 2012/0210925 A1 Aug. 23, 2012

(30) Foreign Application Priority Data

Feb. 17, 2011 (JP) ..... 2011-031987

(51) Int. Cl.
*D05B 1/00* (2006.01)

(52) U.S. Cl.
USPC ..... 112/475.05

(58) Field of Classification Search
USPC ..... 112/470.01, 470.04, 470.05, 470.09, 112/475.05, 475.19
See application file for complete search history.

(56) References Cited

U.S. PATENT DOCUMENTS 5,072,680 A * 12/1991 Nakashima ..... 112/445
6,161,491 A * 12/2000 Takenoya et al. ..... 112/102.5
7,702,415 B2 * 4/2010 Roos ..... 700/138
8,312,826 B2 * 11/2012 Lafferty et al. ..... 112/475.01
8,336,214 B2 * 12/2012 Kawaguchi et al. ..... 33/18.1
2007/0206371 A1 9/2007 Yamasaki

FOREIGN PATENT DOCUMENTS

JP A-09-024172 1/1997
JP A-2001-162078 6/2001
JP A-2007-229344 9/2007

* cited by examiner

*Primary Examiner* — Tejash Patel
(74) *Attorney, Agent, or Firm* — Oliff & Berridge, PLC

(57) ABSTRACT

The sewing machine includes an irradiation unit that irradiates a reference mark providing a basis for locating a workpiece or a sewing pattern in sewing the workpiece placed on a sewing machine bed; a relocation unit that moves the reference mark irradiated on the bed or the workpiece; an imaging unit that captures an image of a predetermined view range including the reference mark irradiated on the bed or the workpiece; a movement identifying unit that identifies a direction of movement and an amount of movement of the reference mark being specified and moved by a user based on the image including the reference mark captured by the imaging unit; and a control unit that controls the relocation unit such that the reference mark irradiated on the bed or the workpiece is moved in correlation with the direction and the amount of movement identified by the movement identifying unit.

12 Claims, 8 Drawing Sheets

SEWING MACHINE AND COMPUTER READABLE MEDIUM

CROSS-REFERENCE TO RELATED APPLICATION

This application is based upon and claims the benefit of priority from the prior Japanese Patent Application 2011-031987, filed on, Feb. 17, 2011, the entire contents of which are incorporated herein by reference.

FIELD

The present disclosure relates to a sewing machine provided with an irradiation unit that irradiates reference marks based upon on which a workpiece and patterns are located when the patterns are sewn on the workpiece placed on the sewing machine bed. The present disclosure also relates to a computer readable medium storing a control program used for relocating the irradiated reference mark to the desired position.

BACKGROUND

When sewing a workpiece with a sewing machine, the layout of the patterns are typically determined by taking a certain spacing from the edges of the workpiece or from an existing pattern on the workpiece. For instance, the user may wish to sew stitches arranged in a straight line that is located at a certain spacing from the edge of the workpiece. To address such requirements, sewing machines have been proposed that is provided with a marking unit that is configured to irradiate reference marks on the sewing machine bed or the workpiece so that location of patterns such as straight stitches or the location of the workpiece can be determined based on the reference mark.

One example of such marking device employs two marking lamps that irradiate cruciform reference marks on the workpiece that indicate the start position and the end position of the straight stitch. In more detail, the marking unit primarily comprises a frame, and adjustment base, an end-point marking lamp and a start point marking lamp. The frame extends in the direction in which the workpiece is fed and the end-point marking lamp is secured on one end of the frame. The start-point marking lamp is provided movably on the frame by way of the adjustment base. The start-point marking lamp, provided on the adjustment base, is moved with the adjustment base which is driven by a step motor. Marking unit is further provided with a counter for inputting the distance, in other words, the amount of movement of the start-point marking lamp.

The counter comprises an input unit provided with buttons for specifying the amount of movement of the start-point marking lamp through numerical input and a display unit for displaying the inputted amount of movement. During the sewing operation, the user is to input the amount of movement of the start-point marking lamp, which is given by the distance between the start point and the end point, through the buttons provided at the input unit. Responsively, the step motor is driven in accordance with the inputted distance to move the start-point marking lamp.

The marking unit, however, requires the user to make numerical inputs of distance through the input unit in order to move the reference mark, that is, to move the marking lamps which can be cumbersome to the user. Further, the location of the irradiated reference mark needs to be verified through the user's eyes and if the reference mark is not located as desired, the numerical input and verification cycle needs to be repeated until the reference mark is properly located, which is again, cumbersome to the user.

SUMMARY

One object of the present disclosure is to provide a user friendly sewing machine that allows the user to readily move the location of the reference mark irradiated on the sewing machine bed or the workpiece to the desired location. The present disclosure also relates to a computer readable medium storing a control program that allows the above described facilitated relocation of the reference mark.

In one aspect, a sewing machine includes an irradiation unit that irradiates a reference mark providing a basis for locating a workpiece or a sewing pattern in sewing the workpiece placed on a sewing machine bed; a relocation unit that moves the reference mark irradiated on the bed or the workpiece; an imaging unit that captures an image of a predetermined view range including the reference mark irradiated on the bed or the workpiece; a movement identifying unit that identifies a direction of movement and an amount of movement of the reference mark being specified and moved to a desired direction by a user based on the image including the reference mark captured by the imaging unit; and a control unit that controls the relocation unit such that the reference mark irradiated on the bed or the workpiece is moved in correlation with the direction of movement and the amount of movement identified by the movement identifying unit.

Other objects, features and advantages of the present disclosure will become clear upon reviewing the following description of the illustrative aspects with reference to the accompanying drawings.

DETAILED DESCRIPTION

A first embodiment of the present disclosure is exemplified through a household sewing machine hereinafter referred to as sewing machine M and will be described in detail with reference to FIGS. 1 to 6.

Figure 1:
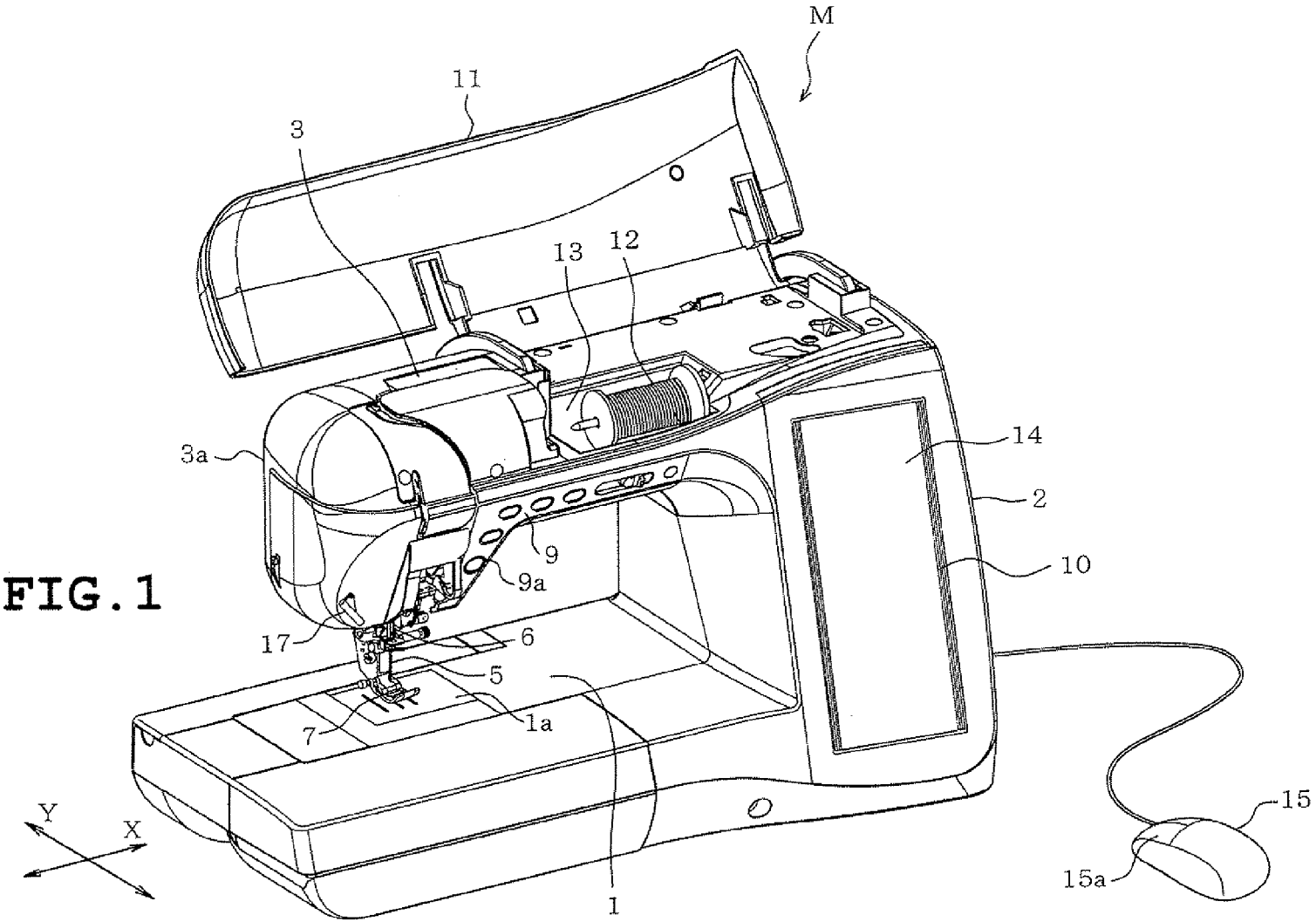
FIG. 1 is a general perspective view of a sewing machine according to a first embodiment.

Referring to FIG. 1, sewing machine M is primarily configured by bed 1, pillar 2, and arm 3 that are structurally integral. Pillar 2 extends upward from the right end of a laterally oriented bed 1. Arm 3 extends leftward from the upper portion of pillar 2 and terminates into head 3*a*. Arm 3 contains a laterally extending main shaft not shown of the sewing machine. Pillar 2 contains sewing machine motor 4 shown in FIG. 4 that drives the main shaft in rotation through a timing belt not shown wound around the main shaft. Description will be given hereinafter with an assumption that the direction in which the user/operator positions himself/herself to face sewing machine M is the forward direction and the opposite side, naturally, is the rear direction. Further, the direction in which pillar 2 is located relative to the center of bed 1 is assumed as the rightward direction and the opposite side, is assumed as the left direction.

Figure 2:
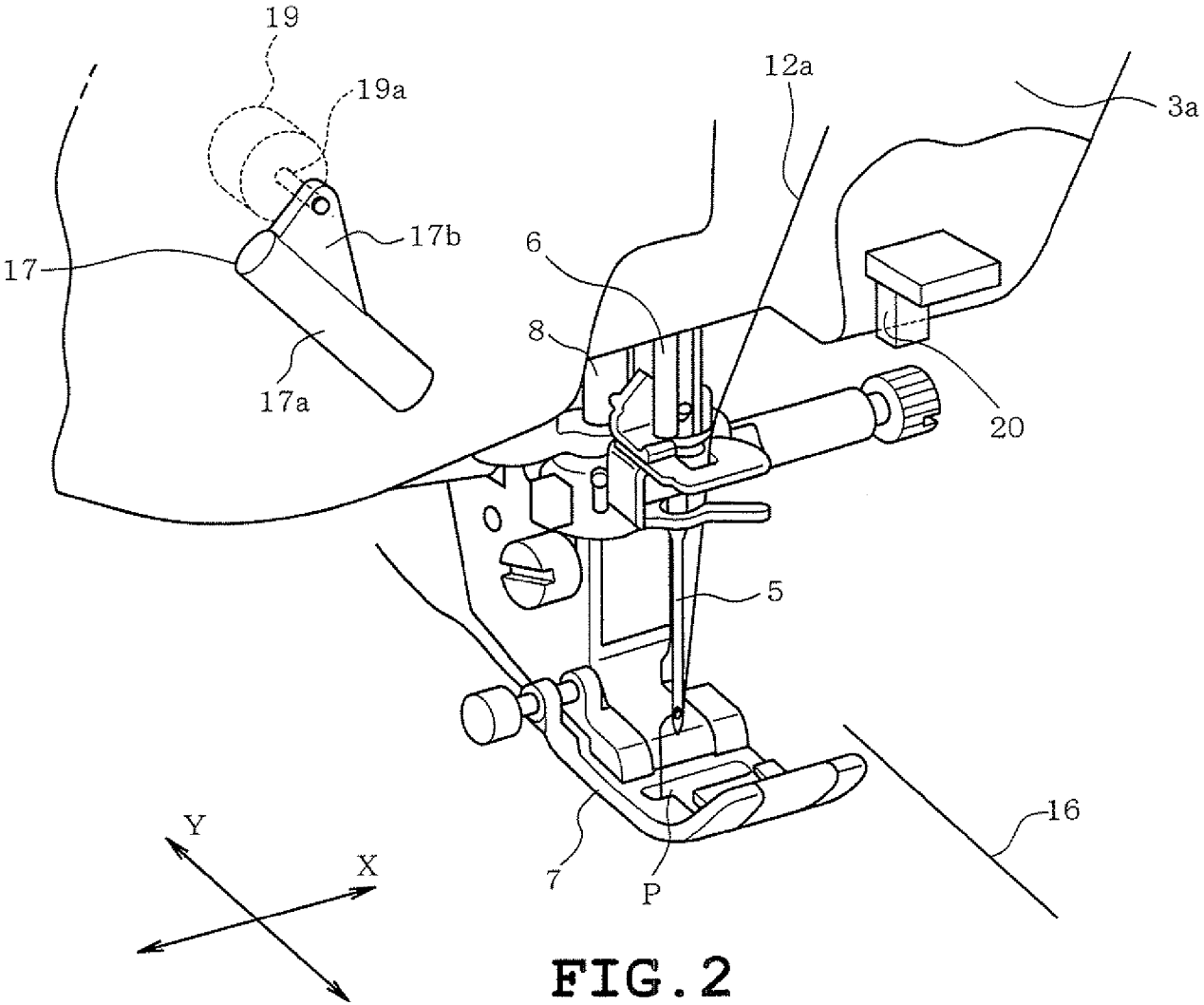
FIG. 2 is an enlarged view of the periphery of a presser foot shown with the left end of an arm of the sewing machine.

Referring to FIG. 2, head 3*a* is provided with needle bar 6 and presser bar 8 not shown. Needle bar 6 has sewing needle 5 attached to it, whereas presser bar 6 has presser foot 7 attached to it. Though not shown, arm 3 further contains components such as a needle-bar drive mechanism, a needle-bar swing mechanism, a thread take-up drive mechanism, and a presser-bar drive mechanism. The needle-bar drive mechanism moves needle bar 6 up and down through the rotation of the main shaft. The needle-bar swing mechanism swings needle bar 6 in a direction orthogonal to the direction in which the workpiece is fed. In the first embodiment, needle bar 6 is swung in the left and right direction. The thread take-up drive mechanism drives the thread-take up and down in synchronism with the up and down movement of needle bar 6. The presser-bar drive mechanism drives presser bar 8 up and down.

At the upper portion of arm 3, openable/closable cover 11 is provided that, when opened, reveals storage 13 defined on the forward mid portion of arm 3 for storing thread spool 12. Needle thread 12*a* only shown in FIG. 2 drawn from thread spool 12 is engaged with a number of components such as the thread take-up that define a thread passageway to be ultimately supplied to sewing needle 5.

On the front side of arm 3, various key switches 9 are provided for user operation. Though not described in detail, key switches 9 include start/stop switch 9*a* for starting and stopping a sewing operation, pause key 9*a*, a reverse stitch key, a needle lifting/dropping key, a thread cut key, and speed adjustment dial. On the front face of pillar 2, a sizable and vertically elongate liquid crystal display 10 capable of displaying in full color is provided, which is hereinafter simply referred to as LCD 10.

Figure 3:
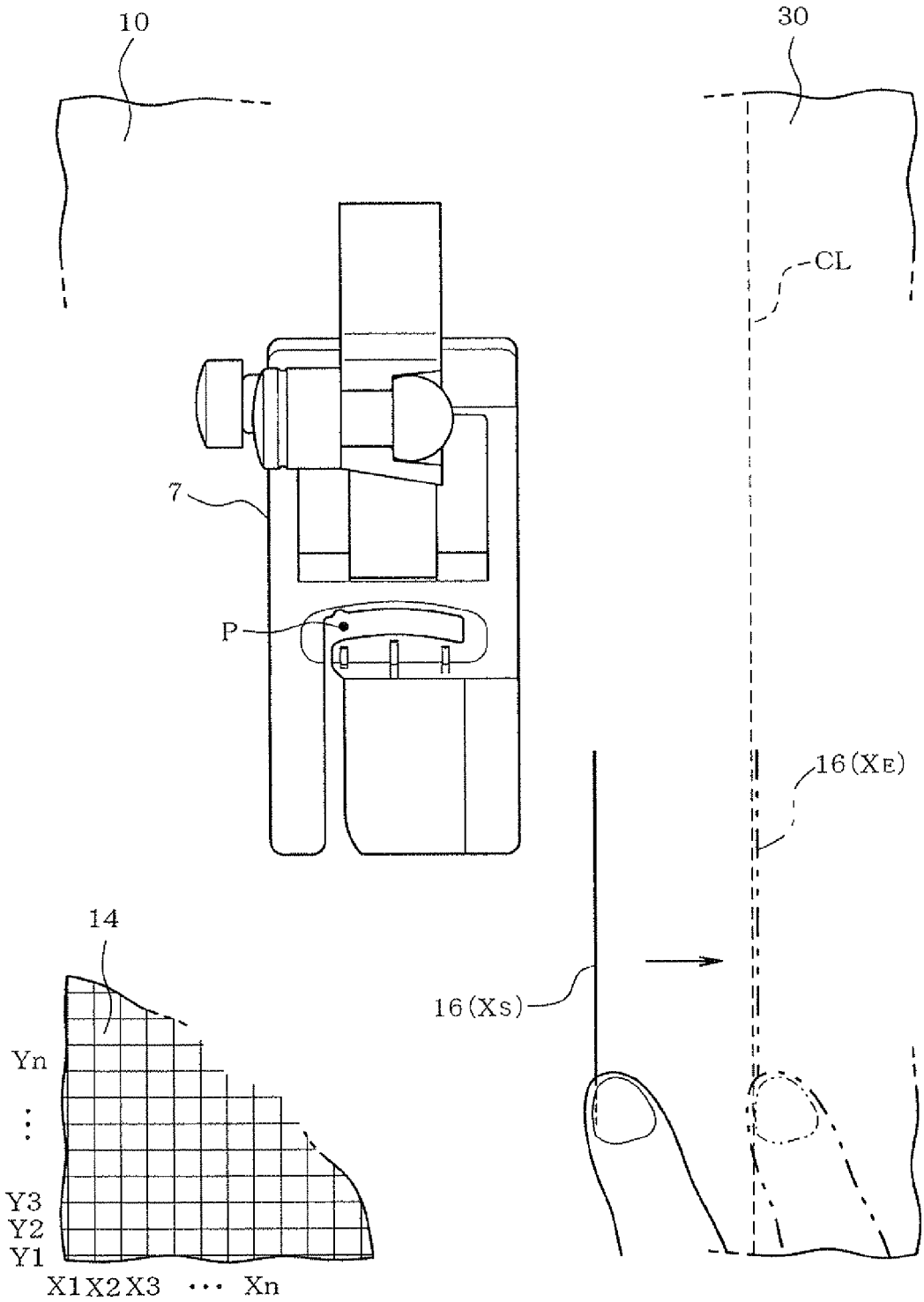
FIG. 3 is one example of a screen shown on the display.

LCD 10 displays various information such as selection of patterns that can be sewn, names of various functionalities to be executed in a sewing operation, and various messages that are outputted. Examples of patterns that can be sewn include utility stitches such as straight stitches and zigzag stitches, decorative patterns of plants, geometric figures, etc. and various types of patterns that can be sewn with sewing machine M. LCD 10 also displays images captured by the later described image sensor 20 shown in FIG. 2. FIG. 3 illustrates screen 30 displayed on LCD 10 that shows one example of such image which shows a plan view of the periphery of presser foot 7. Reference symbol P shown in FIG. 3 is a needle drop point.

On the front side of LCD 10, touch panel 14 is superimposed which is configured by a matrix of transparent touch switches for inputting coordinate information. LCD 10 and touch panel 14 are thus, configured as a display/input unit capable of outputting images and inputting coordinate information through the same screen. The touch switch employs, for instance, a resistance sensitive type and is configured by a matrix of resistors aligned in the longitudinal and lateral directions spaced at predetermined intervals as represented by Xn and Yn in FIG. 3. When the user touches a given location on the touch switch typically by his/her fingers, the intersection of the longitude and the latitude of the sensed resistor is scanned to detect the touched location.

By sensing the location of the touch, various judgments can be made such as what to display, what to select (e.g., patterns to be sewn and functions to be executed), and what to specify (e.g., parameters to be specified). When LCD 10 is displaying the screen shown in FIG. 3, the longitudinal and lateral coordinates on touch panel 14 of the displayed screen correspond to the X direction representing the left and right direction and the Y direction representing the forward and reward direction. The coordinates, hereinafter also referred to as the X coordinate and the Y coordinate are sensed on touch panel 14 by the variation in the resistance value of the resistor residing in the location corresponding to the touched location. Touch panel 14 is not limited to the resistance sensitive type that identifies the touched location based on the coordinate system, but may employ other types that are capable of identifying the touched location.

On the side surface of pillar 2, a connecting port not shown is provided for allowing removable connection of mouse 15 serving as a pointing device. Mouse 15 may also be connected to sewing machine M through wireless communication.

On the upper surface of bed 1, needle plate 1*a* is provided. Within bed 1 below needle plate 1*a*, components such as a feed mechanism, a horizontal rotary hook mechanism, and a thread cutter are provided neither of which are shown. The feed mechanism drives a feed dog up and down and back and forth. The horizontal rotary hook mechanism contains a bobbin and forms stitches in cooperation with sewing needle 5. The thread cutter mechanism cuts needle thread and bobbin thread.

Sewing machine M is further provided with an irradiation unit that irradiates a reference mark when sewing workpiece cloth CL shown in FIG. 3 placed on bed 1. The reference mark serves as a reference for locating workpiece CL or locating the pattern to be sewn on workpiece CL. The irradiation unit will be described with reference to FIGS. 2 and 3.

The irradiation unit comprises laser pointer 17 which is located at the forward lower edge of head 3*a* so as to be located forward and leftwardly upward from presser foot 7 or needle drop point P. Laser pointer 17 comprises a cylindrical body 17*a* and mounting section 17*b* that are structurally integral. Mounting section 17*b* is mounted on movement motor 19. Though not shown, body 17*a* includes a light emitting section that emits a laser beam, optics such as lens for spreading the laser beam linearly. Laser pointer 17 is thus, configured as a marking light that irradiates reference mark 16 on bed 1 or workpiece CL. Laser pointer 17 is one example of the irradiating unit. Reference mark 16 is exemplified as a straight baseline oriented in the forward and rear direction but is not limited to the same.

Transfer motor 19 comprises a step motor for example and is secured on the machine frame of head 3*a* such that its rotary shaft 19*a* is oriented in the Y direction. Rotary shaft 19*a* allows the attachment of mounting section 17*b* of laser pointer 17. Thus, laser pointer 17 is disposed on head 3*a* so as to be oriented downward and rearwardly rightward toward bed 1. Transfer motor 19 is one example of a relocation unit that, when driven, makes adjustments in the disposition, in this case, the inclination of laser pointer 17 to relocate the irradiated reference mark 16 in the X direction.

At the forward lower edge of head 3*a* image sensor 20 is provided so as to be located forward and rightwardly upward from presser foot 7 or needle drop point P. In first embodiment, image sensor 20 is configured, for instance, by a small CMOS (Complementary Metal Oxide Semiconductor) imaging device. Image sensor 20 is one example of an imaging unit that captures images of a predetermined view range including reference mark 16 irradiated on bed 1 or workpiece CL.

Image sensor 20 is thus, configured to capture images of reference mark 16 as well as the periphery of presser foot 7. The captured images are displayed on LCD 10 as shown in FIG. 3. Thus, displaying the captured images on LCD 10 allows the user to readily recognize the location of both reference mark 16 and presser foot 7 on bed 1 or workpiece CL.

Figure 4:
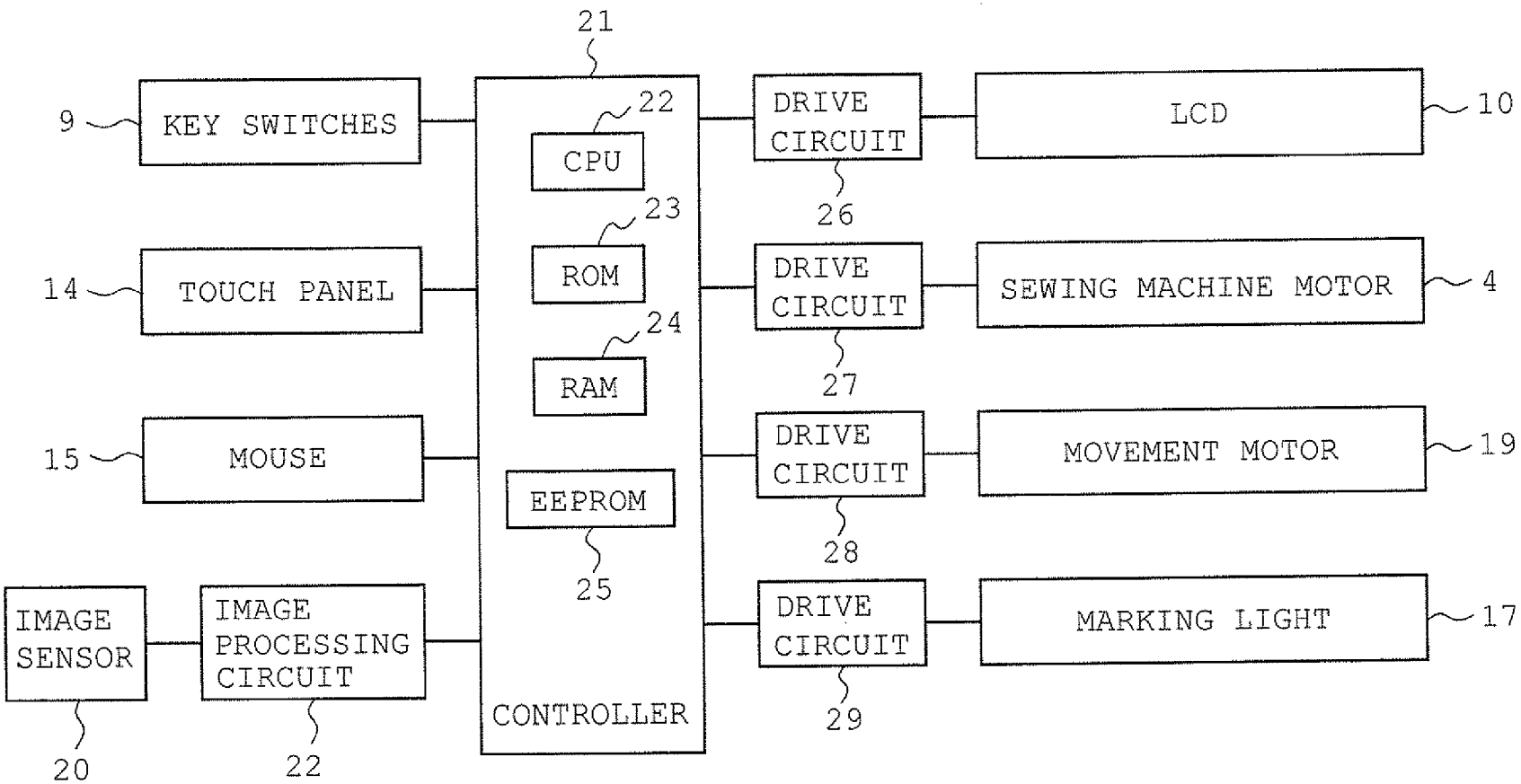
FIG. 4 is a block diagram indicating an electrical configuration of the sewing machine.

Next, a description will be given on a control system sewing machine M with reference to the block diagram of FIG. 4.

Controller 21, responsible for overall control of sewing machine M, is primarily configured by a microcomputer including CPU 22, ROM 23, RAM 24, EEPROM 25. Controller 21 establishes connections with components such as key switches 9 including start/stop switch 9*a*, touch panel 14, mouse 15, and image processing circuit 22 to which image sensor 20. Controller 21 further establishes connection with components such as LCD 10, sewing machine motor 4, movement motor 19, and laser pointer 17 through drive circuits 26, 27, 28, and 29 that drive the foregoing components.

ROM 23 pre-stores items such as a control program for controlling the sewing operation, sewing data of sewing patterns, and a display control program that controls LCD 10. ROM 23 further pre-stores a relocation control program that controls movement motor 19 by identifying the direction and the amount of movement of reference mark 16.

Controller 21 is one example of a control unit and identifies the direction and the amount of reference mark 16 inputted by the user through the software configuration of sewing machine M, that is, through the execution of the relocation control program as will be described below.

In starting a sewing operation, controller 21 captures an image of reference mark 16 located in the proximity of presser foot 7 by image sensor 20. The captured image is displayed on LCD 10 and is also subjected to a later described image processing by image processing circuit 22 whereby controller 21 identifies reference mark 16. Touch panel 14 and controller 21 are examples of a movement identifying unit that identifies the direction and amount of movement through user's touch operation of touch panel 14. The "touch operation" includes (a) placing the user's finger in contact with touch panel, (b) moving the finger while maintaining the contact, and (c) releasing the finger placed in contact with touch panel 14. The "touched location" indicates the location where the finger contact is established on touch panel 14. The touch operation may be effected by a touch pen instead of the user's finger.

Controller 21 acquires the X coordinate by scanning based on the variation in the resistance of the resistor located in the touched location. By determining whether or not the acquired X coordinate corresponds to the location of reference mark 16 displayed on LCD 10, controller 21 determines the presence/absence of the specification of reference mark 16 by the user. Controller 21 stores the X coordinate into RAM 24 which is one example of a storage device, and compares the X coordinate stored in RAM 24 with the X coordinate obtained in the subsequent scanning. Thus, controller 21 determines whether or not the user's finger movement on touch panel 14, in other words, the user's instructions on the direction of movement is rightward or leftward. Further, the amount of movement of the specified reference mark 16 is calculated based on the difference between the X coordinate acquired when reference mark 16 was specified and the X coordinate acquired when the user's finger was released from touch panel 14.

Figure 5:
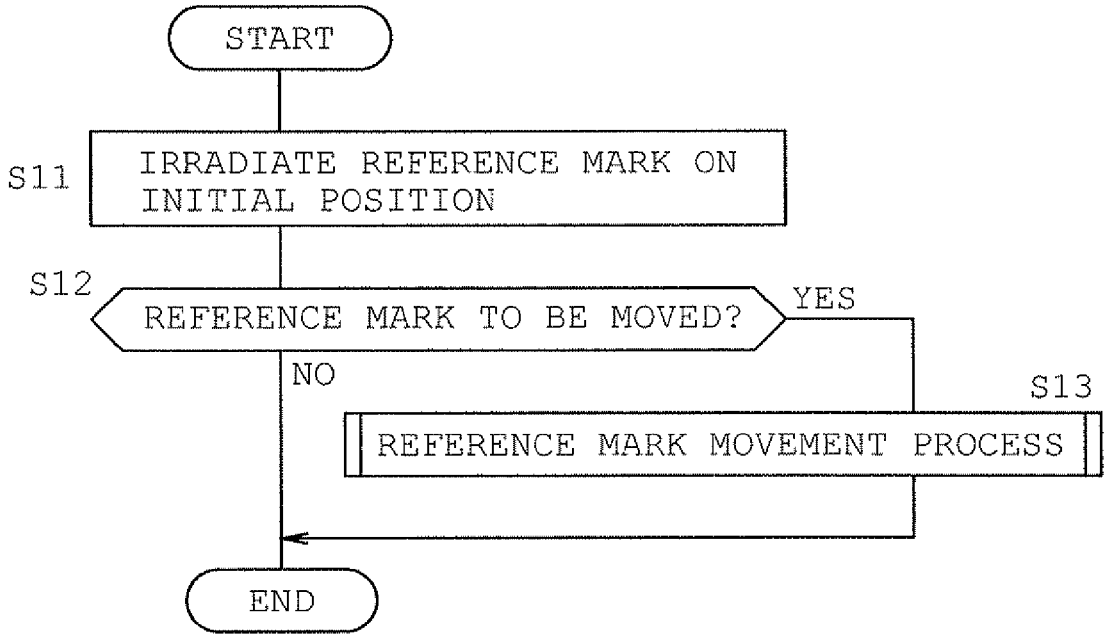
FIG. 5 is a flowchart indicating the overall process flow of reference mark irradiation.

The process flow involved in the user input through touch panel 14 and the correlated movement of reference mark 16 will be described in more detail with reference to FIGS. 5 and 6. The flowcharts of FIGS. 5 and 6 indicate the process flow of relocation control program executed by control unit 21 and each step of the process flow are identified by reference symbols Si (i=11, 12, 13 . . . ).

After the main power of sewing machine M is turned on, laser pointer 17 is positioned to irradiate reference mark 16 at initial position $x_S$ shown in FIG. 3 that is located for instance, 10 mm to the right of needle drop point P on bed 1 or workpiece CL. The user is prompted to initiate the irradiation of reference mark 16 on screens not shown displayed on LCD 10 for making various settings through touch panel 14 operation. Laser pointer 17 thus, irradiates reference mark 16 appearing as a straight base line at initial position $x_S$ located on bed 1 or workpiece CL (step S11). Alternatively, a dedicated switch may be provided for starting and stopping the irradiation of reference mark 16.

The following description is based on an example in which the user wishes to form a straight stitch located more than 10 mm away from one of the side ends of workpiece CL as shown in broken line of FIG. 3. In this case, reference mark 16 needs to be moved to the right. In order to relocate reference mark 16 to the desired location, the user is to select "relocate reference mark 16" through the operation of touch panel 14 in the setting screen (step S12: YES). Responsively, relocation process of the irradiated reference mark 16 is executed as shown in FIG. 6. To elaborate on the relocation process, image sensor 20 captures images of a predetermined range of area including reference mark 16 and presser foot 7 from the forward and rightwardly upward direction (step S21). As a result, a substantially planar image partially showing the predetermined range of area is displayed on screen 30 of LCD 10 as can be seen in FIG. 3 (step S22). Further, though not shown in the flowchart, known image processing of the captured images is executed by image processing circuit 22 such as binarization and outline extraction. The image processing obtains the location of reference mark 16 on LCD 10 (step S23).

The user, on the other hand, operates touch panel 14 to relocate the irradiated reference mark 16 to the desired position. Controller 21 acquires the X coordinate by scanning based on the variation in the resistance of the resistor located in the touched location and stores the acquired X coordinate into RAM 24. Then, a judgment is made as to whether or not the acquired X coordinate corresponds to the location of reference mark 16 displayed on LCD 10, whereby controller 21 determines the presence/absence of the specification of reference mark 16 by the user (step S24). In case the x-coordinate is not in the location corresponding to reference mark 16 (step S24: NO), steps S24 and 25 are repeated until the user's finger is no longer in contact with touch panel 14. In case the user's finger is released from panel 14 (step S25: YES) without any specification of reference mark 16 (step S24: NO), the process is terminated without relocating the irradiated reference mark 16. An end key may be provided additionally on screen 30 of LCD 10 to end the process through operation of the end key.

FIG. 3 shows how reference mark 16 is specified. As shown in a solid line, reference mark 16 is specified by placing the user's finger over reference mark 16 of LCD 10 (step S24: YES). By comparing the X coordinate obtained when reference mark 16 is specified and the X coordinate obtained by re-scanning, a judgment is made as to whether or not the user's finger was moved to the left or the right on touch panel 14 (step S26). To summarize, repetitive scanning executed during the touch operation causes multiple X coordinates to be stored into RAM 24. Then, the direction and the amount of reference mark 16 movement is calculated (step S27) based on the difference of the X coordinate obtained when the user's finger was released from touch panel 14 and the X coordinate ($x_S$) when reference mark 16 was specified.

For instance, assuming that reference mark 16 is specified at initial location $x_S$ and the user's finger was released from touch panel 14 at location $x_E$ as shown by double-dot-chain line indicated in FIG. 3, controller 21 identifies a rightward movement in steps S26 and S27 and the distance ($x_E$-$x_S$) of the rightward movement is calculated as the amount of movement. Based on the direction and the distance thus identified, controller 21 translates the same into the direction and the amount of rotation of movement motor 19 through calculation (step S28). The result of calculation is converted into a signal which is outputted to drive movement motor 19 in rotation and consequently change the angle of inclination of laser pointer 17 (step S29). Accordingly, reference mark 16 irradiated on bed 1 or workpiece CL is moved to a location to the right of the initial position and being spaced by the distance corresponding to the amount of finger movement ($x_E$-$x_S$). The foregoing steps S21 to S29 are repeated until the user completes the relocation process of reference mark 16 (step S25: YES).

As described above, the user is allowed to readily relocate the irradiated reference mark 16 to the desired location by direct finger operation of touch panel 14.

According to the first embodiment, sewing machine M is provided with a movement identifying unit that identifies the direction and the amount of movement of reference mark 16 based on the user's specification of the image of reference mark 6 displayed on LCD 10 and the subsequent movement of reference mark 16 in the desired direction. Controller 21 implements this feature through execution of the movement identifying process (steps S22 to S27) that identifies the direction and the amount of movement and the motor control process (steps S28 and 29) that controls movement motor 19 to move reference mark 16 irradiated on bed 1 or workpiece CL in the direction and distance corresponding to the identified direction and distance. Thus, by capturing an image of a predetermined range of area including reference mark 16, the user is allowed to specify reference mark 16 through the captured image and move reference mark 16 to the desired location. The direction of movement and the amount of movement made by user operation can be identified through the captured image. Accordingly, controller 21 is allowed to move the location where reference mark 16 is irradiated by driving movement motor 19 by based on the identified direction of movement and the amount of movement. Thus, cumbersome tasks such as numerical input of movement amount and verification of the resulting movement amount can be eliminated to allow the user to readily relocate reference mark 16 to the desired location.

Movement identifying unit specifies reference mark 16 displayed on LCD 10 and further identifies the direction and the amount of movement of reference mark 16 made through LCD 10. Thus, the user is allowed to readily make necessary inputs for relocating reference mark 16 by utilizing the resources displayed on LCD 10.

Touch panel 14 is provided on LCD 10 and detects the specification of reference mark 16 as well as the direction and the amount of movement of reference mark 16. Thus, the user is allowed to readily relocate the irradiated reference mark 16 to the desired position by operating touch panel 14 on LCD 10 directly, thereby improving the usability of the system.

Image sensor 20 captures the image of reference mark 16 as well as the periphery of presser foot 7 and LCD 10 displays the captured image. Thus, the user is able to readily recognize the location of the irradiated reference mark 16 and the location of presser foot 7.

Figure 7:
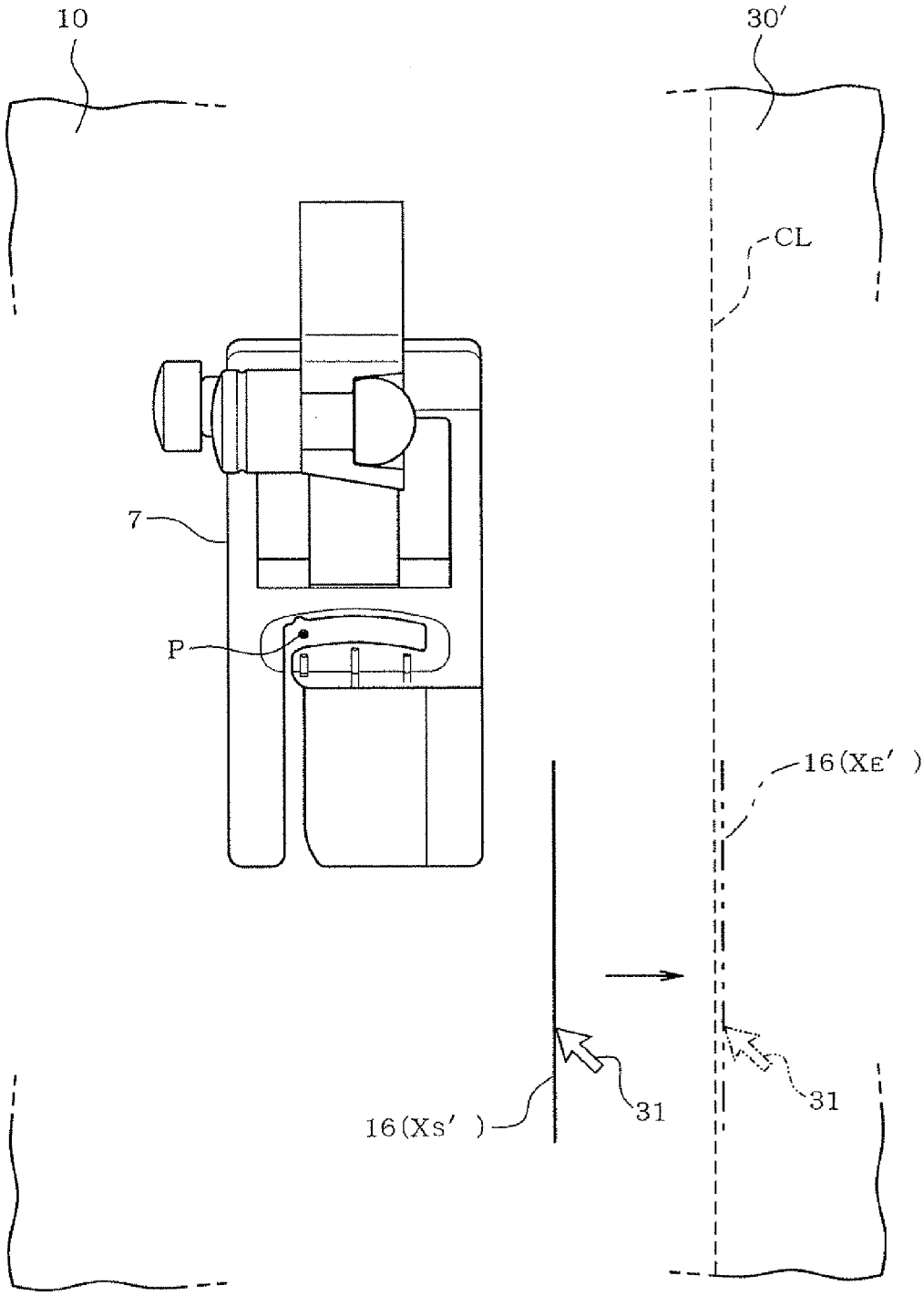
FIG. 7 illustrates a second embodiment and corresponds to FIG. 3.

FIG. 7 illustrates a second embodiment and the elements that are identical to those of the first embodiment are identified with identical reference symbols and are not re-described. Description will be given on the difference from the first embodiment. The second embodiment differs from the first embodiment in that mouse 15 serves as an example of movement identifying unit to specify reference mark 16 and determine the direction and the amount in which reference mark 16 is moved.

Figure 6:
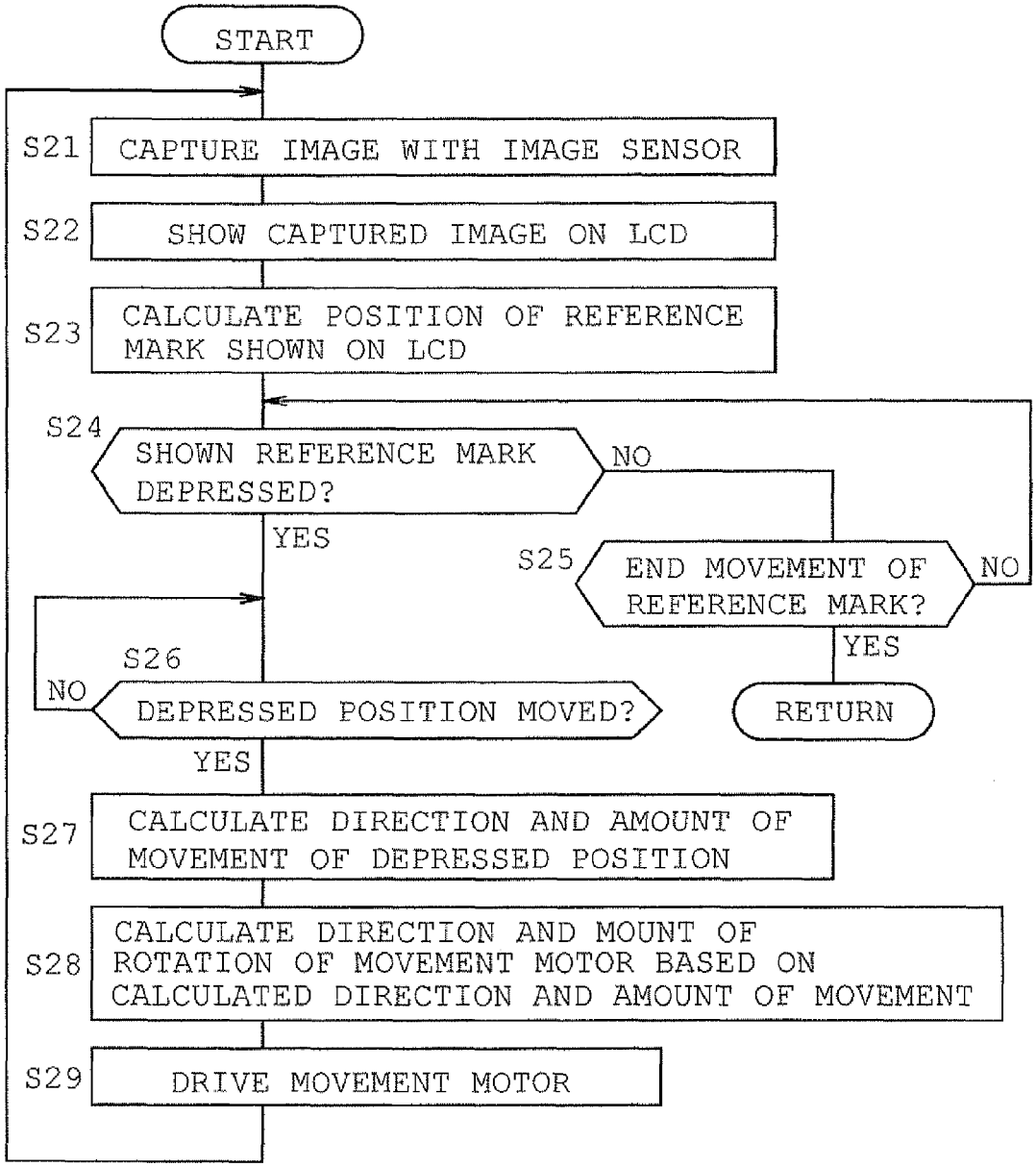
FIG. 6 is a flowchart indicating the process flow of reference mark relocation based on touch panel operation.

Step S24 shown in FIG. 6 is replaced, for instance, by the user's clicking of left button 15*a* provided on mouse 15 in which response, the current location of the mouse cursor on LCD 10 is read. Then, a judgment is made as to whether or not the coordinates of the mouse cursor and the coordinates of reference mark 16 on LCD 10 are identical, in other words, whether or not the X coordinates of the mouse cursor and the reference mark 16 are identical as represented by $x_S'$ in FIG. 7. If the X coordinates are identical, reference mark 16 is deemed to have been specified. In screen 30' of FIG. 7, the specified reference mark 16 and mouse cursor, hereinafter also referred to as cursor 31 are represented by a solid line.

Further, step S27 of the first embodiment is replaced by a judgment on the presence/absence of the so called dragging operation, in which the mouse 15 is moved by the user while maintaining the depression of left button 15*a*. If the drag operation was performed and the so called drop operation, in which depression of left button 15*a* is released by the user after the drag operation is performed, the location where the drop operation was performed, represented as $x_E'$ in FIG. 7 is read. Based on the difference between coordinate $x_E'$ read at the drop operation and $x_S'$ read at the specification of reference mark 16, the direction and the amount of movement of reference mark 16 instructed by the user can be identified (step S27).

According to the second embodiment, mouse 15 is used as a pointing device to specify reference mark 16 and instruct the direction and the amount of movement. As a result, the operation of instructing the relocation of reference mark 16 can be simplified. Further, the advantages of the first embodiment in which the user is allowed to readily make necessary inputs for relocating reference mark 16 through the resources displayed on LCD 10 can also be obtained in the second embodiment as well.

The user's operation of mouse 15 is not limited to the drag and drop operation. Alternative operations utilizing the right button may be employed as well. If the mouse comes with a wheel, the specification of reference mark 16, and determination of the direction and the amount of movement may be made based on the direction and the amount of rotation of the wheel.

Figure 8:
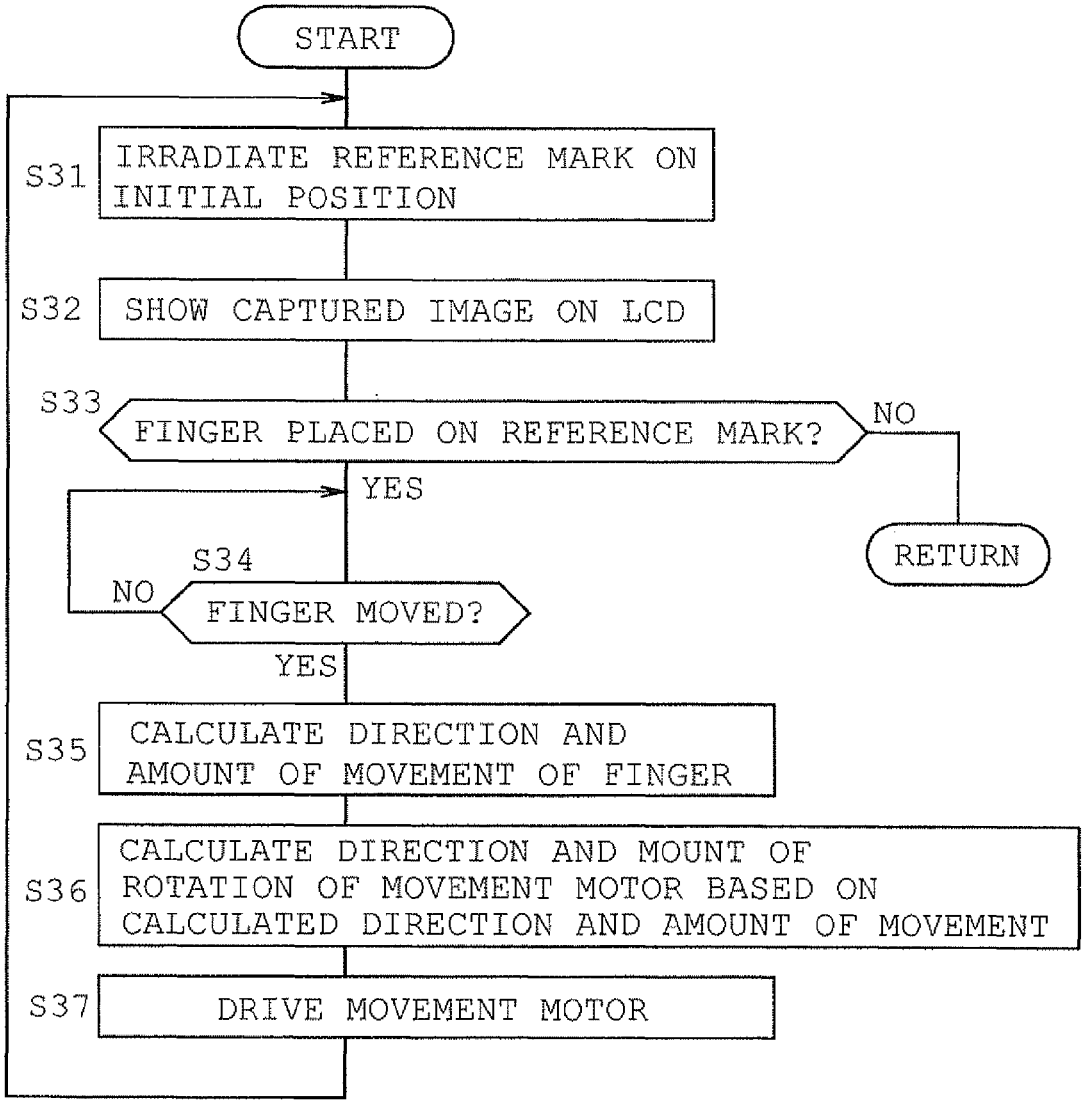
FIG. 8 is a flowchart indicating a third embodiment and shows the process flow of reference mark relocation by directly touching the reference mark irradiated on a sewing machine bed.

FIG. 8 illustrates a third embodiment. In the third embodiment, the user is allowed to directly specify reference mark irradiated on bed 1 or workpiece CL with the user's finger. The processes indicated in FIGS. 5 and 6, namely steps S11 to S13 and steps S21 to S29 are replaced by the following.

In starting a sewing operation, laser pointer 17 irradiates linear reference mark 16 from the light emitting section on initial position $x_S$ located on bed 1 or workpiece CL (step S31). Then, image sensor 20 captures images of a predetermined range of area including reference mark 16 and presser foot 7 from the forward and the rightwardly upward direction (step S32). During this time, controller 21 determines whether or not the user has directly specified reference mark 16 located on bed 1 or workpiece WL by his/her finger based on the captured images (step S33). The image recognition of reference mark 16 and the user's finger may be carried out through known methods. For instance, image processing circuit 22 may be configured to binarize the captured image and extract its out line, whereafter the image may be further processed by template matching for the finger and reference mark 16 recognition. The direction and the amount of finger movement may be detected by background subtraction.

In the absence of the user's finger specification of reference mark 16 (step S33: NO), the irradiated reference mark 16 is not relocated, meaning that the relocation process is terminated and the control is return to proceed with the sewing process. In the presence of the user's finger specification of reference mark 16 (step S33: YES), a judgment is subsequently made as to whether or not the finger movement was directed rightward (step S34). More specifically, controller 21 identifies the direction and the amount of movement of reference mark 16 based on the difference between the X coordinate when the user's finger was released from bed 1 or workpiece CL and the X coordinate ($x_S$) when reference mark 16 was specified (step S35). Based on the direction and the distance thus identified, controller 21 translates the same into the rotational direction and the rotational amount of movement motor 19 through calculation (step S36). The result of calculation is converted into a signal which is outputted to drive movement motor 19 in rotation and consequently change the angle of inclination of laser pointer 17 (step S37). Accordingly, reference mark 16 irradiated on bed 1 or workpiece CL is relocated to the right or left from the initial position to the location in the distance corresponding to the amount of user's finger movement. The foregoing steps S32 to S37 are repeated until the user completes the relocation process of reference mark 16 (step S33: NO).

Thus, the user is allowed to directly instruct the relocation of reference mark 16 located on bed 1 or workpiece WL without having to operate any input operation units such as touch panel 14 or mouse 15. Steps S33 to S35 of the third embodiment are examples of movement identifying routine and steps 36 and S37 are examples of the control routine.

As described above, controller 21 is one example of a calculating unit, and executes a calculation routine which is exemplified as steps S34 and S35. Based on the images captured by image sensor 20, the calculation routine calculates the direction and the amount of movement of reference mark 16 which is carried out by specifying reference mark 16 through placement of the user's finger over reference mark 16 irradiated on bed 1 or workpiece CL and moving the finger to the desired location while maintaining contact with the reference mark 16 displayed on LCD. Thus, the direction and the amount of the user's finger movement are translated into rotation of movement motor 19 to allow relocation of reference mark 16. As a result, a user friendly interface can be provided that allows instructions for reference mark 16 relocation to be given directly by associating the user's finger movement to the movement of the reference mark 16.

The present disclosure is not limited to the foregoing embodiments but modified or expanded as follows.

Irradiation unit is not limited to laser pointer 17 that irradiates laser beam, but may be configured by a projecting unit that projects a certain image on bed 1 or workpiece WL. The projecting unit may be configured as a compact projector comprising a light emitting section employing an LED, optical lens, and light blocking section. The mark formed on the light blocking section may be varied to provide various shapes of reference marks such as cruciform and circular marks in addition to the liner baseline.

In the foregoing embodiments, the relocation of the reference mark was explained through X directional movement representing the left and right directional movement, but the relocation may also be made in the Y direction or even diagonally. That is, in the first to the third embodiments, the operation of touch panel 14, the operation of cursor 31 through mouse 15, and the operation through direct finger contact on bed 1 or workpiece CL may be executed through acquisition of Y coordinates or both X and Y coordinates by controller 21. This will allow the Y coordinates to be identified in addition to the X coordinates in determining the direction and the amount of movement of the reference mark. The reference mark is moved in the Y direction and/or diagonally by transferring the irradiation unit by the relocation unit.

The operation of touch panel 14 of the first embodiment, and the operation through direct finger contact on bed 1 or workpiece CL of the third embodiment are not limited to finger operation but may be done with touch pens or the like. The mouse serving as the pointing device in the second embodiment may be replaced by other devices such as a joy stick and a track ball.

The computer readable medium storing the relocation control program is not limited to ROM 23 provided to controller 21 but may come in the form of a CD-ROM, flexible disk, DVD, memory cards, or the like. Reading the relocation program from the computer readable medium into the computer provided in the controller of the sewing machine will provide operation and effect similar to those discussed in the foregoing embodiments.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A non-transitory computer readable medium for use with a sewing machine including an irradiation unit that irradiates a reference mark providing a basis for locating a workpiece or a sewing pattern in sewing the workpiece placed on a sewing machine bed, a relocation unit that moves the reference mark irradiated on the bed or the workpiece; and an imaging unit that captures an image of a predetermined view range including the reference mark irradiated on the bed or the workpiece and a presser foot of the sewing machine; the computer readable medium storing a control program for relocating the irradiated reference mark to a location desired by a user, the control program comprising:

instructions for identifying a direction of movement and an amount of movement of the reference mark with respect to the presser foot when the reference mark is specified and moved to a desired location by the user based on the image including the reference mark and the presser foot captured by the imaging unit, and instructions for controlling the relocation unit such that the reference mark irradiated on the bed or the workpiece is moved in correlation with the direction of movement and the amount of movement identified by the identifying.

2. The medium according to claim 1, wherein the relocation unit is attached to the irradiation unit, and the control program further comprises instructions for moving the reference mark by moving the irradiation unit.

3. The medium according to claim 2, wherein the sewing machine includes a display that displays the image including the reference mark captured by the imaging unit, wherein the identifying identifies the direction of movement and the amount of movement of the reference mark being specified by a user on the display and being moved to a desired direction on the display.

4. The medium according to claim 3, wherein the sewing machine includes a touch panel provided on the display and the identifying further instructs the touch panel to detect the user specification of the reference mark, and the direction of movement as well as the amount of movement of the reference mark.

5. The medium according to claim 3, wherein a pointing device is connected to the sewing machine and the identifying further instructs the pointing device to instruct specification of the reference mark and instruct the direction of movement and the amount of movement of the reference mark.

6. The medium according to claim 2, wherein the identifying further includes instructions for calculating the direction of movement and the amount of movement of the reference mark being irradiated on the bed or the workpiece when the reference mark is moved while being specified by a user's finger, and wherein the controlling controls the relocation unit such that the reference mark being irradiated on the bed or the workpiece is moved in correlation with the movement of the user's finger based on the direction and the amount of movement calculated by the calculating.

7. A sewing machine comprising:

an irradiation unit that is configured to irradiate a reference mark providing a basis for locating a workpiece or a sewing pattern in sewing the workpiece placed on a sewing machine bed;

a relocation unit that is configuired to move the reference mark irradiated on the bed or the workpiece;

an imaging unit that is configured to capture an image of a predetermined view range including the reference mark irradiated on the bed or the workpiece and a presser foot of the sewing machine;

a movement identifying unit that is configured to identify a direction of movement and an amount of movement of the reference mark with respect to the presser foot when the reference mark is specified and moved to a desired direction by a user based on the image including the reference mark and the presser foot captured by the imaging unit; and a control unit that is configured to control the relocation unit such that the reference mark irradiated on the bed or the workpiece is moved in correlation with the direction of movement and the amount of movement identified by the movement identifying unit.

8. The sewing machine according to claim 7, wherein the relocation unit is attached to the irradiation unit and is configured to move the reference mark by moving the irradiation unit.

9. The sewing machine according to claim 8, further comprising a display that displays the image including the reference mark captured by the imaging unit, wherein the movement identifying unit identifies the direction of movement and the amount of movement of the reference mark being specified by a user on the display and being moved to a desired direction on the display.

10. The sewing machine according to claim 9, wherein the movement identifying unit includes a touch panel provided on the display and the touch panel detects the user specification of the reference mark and the direction of movement as well as the amount of movement of the reference mark.

11. The sewing machine according to claim 9, wherein the movement identifying unit is further provided with a pointing device that is connected to the sewing machine and that instructs the specification of the reference mark and the direction of movement as well as the amount of the movement of the reference mark.

12. The sewing machine according to claim 8, wherein the movement identifying unit includes a calculating unit that calculates the direction of movement and the amount of movement of the reference mark being irradiated on the bed or the workpiece when the reference mark is moved while being specified by a user's finger, and wherein the controller controls the relocation unit such that the reference mark being irradiated on the bed or the workpiece is moved in correlation with the movement of the user's finger based on the direction of movement and the amount of movement calculated by the calculating unit.

* * * * *